US005087302A

United States Patent [19]

Lin et al.

[11] Patent Number: 5,087,302

[45] Date of Patent: Feb. 11, 1992

[54] PROCESS FOR PRODUCING RARE EARTH MAGNET

[75] Inventors: Cheng H. Lin; Shi K. Chen; Ying C. Hung; Wen S. Ko; Wen C. Chang, all of Hsinchu, Taiwan

[73] Assignee: Industrial Technology Research Institute, Taiwan

[21] Appl. No.: 644,114

[22] Filed: Jan. 18, 1991

Related U.S. Application Data

[63] Continuation-in-part of Ser. No. 353,869, May 15, 1989, abandoned.

[51] Int. Cl.[5] ..... H01F 1/02

[52] U.S. Cl. ..... 148/103; 419/12; 419/35; 148/104

[58] Field of Search ..... 148/101, 103, 104, 105, 148/108; 419/12, 35

[56] References Cited

U.S. PATENT DOCUMENTS

| | | | |
|---|---|---|---|
| 3,821,035 | 6/1974 | Martin | 148/101 |
| 3,892,600 | 7/1975 | Smeggil et al. | 148/103 |
| 3,964,939 | 6/1976 | Chandross et al. | 148/105 |
| 4,497,722 | 2/1985 | Tschida et al. | 252/62.54 |
| 4,597,938 | 7/1986 | Matsuura et al. | 419/23 |

FOREIGN PATENT DOCUMENTS

| | | | |
|---|---|---|---|
| 60-14406 | 1/1985 | Japan . | |
| 60-188459 | 9/1985 | Japan . | |
| 60-244004 | 12/1985 | Japan . | |
| 61-90401 | 5/1986 | Japan . | |
| 62-259223 | 11/1987 | Japan | 148/121 |

*Primary Examiner*—John P. Sheehan

*Attorney, Agent, or Firm*—Scully, Scott, Murphy & Presser

[57] ABSTRACT

A process for producing a rare earth magnet of magnetically improved performance wherein a specific titanate coupling agent is added in one step of the process to enhance the oxidation resistance of the raw materials during production and a special degassing step is incorporated to allow for the removal of the residual titanate coupling agent. The resultant rare earth magnet exhibits improved maximum magnetic energy product ($(BH)_{max}$) and magnetic coercive force ($H_c$) as well as other magnetic properties. Rare earth magnet produced by the process is also disclosed.

13 Claims, 2 Drawing Sheets

PROCESS FOR PRODUCING RARE EARTH MAGNET

CROSS REFERENCE TO RELATED APPLICATIONS

This is a continuation-in-part of U.S. Ser. No. 353,869 filed May 15, 1989 entitled IMPROVED PROCESS FOR PRODUCING RARE EARTH MAGNET, now abandoned.

BACKGROUND OF THE INVENTION

It has long been desirable to provide relatively inexpensive, high performance permanent magnets. The performance of such permanent magnets is determined by, for example, coercive force ($H_c$) or coercivity, remanent magnetization (Br) or remanence and maximum magnetic energy product $(BH)_{max}$.

The search for satisfactory permanent magnets, has lead to permanent magnets composed of rare earth elements and the element cobalt, most significantly samarium-cobalt magnets. These have been prominent since the 1970's. Because of their unquestionable superiority in magnetic performance, the rare earth-cobalt magnets have governed over 20% of the present permanent magnet market. However, since rare earth powders are highly active in air and in some cases are highly ignitable, great care should be taken in preventing the oxidation thereof in their production. Many remedial means have been devised to overcome these problems. Some of them involve the use of anti-oxidants.

Motivated by the high cost and relative scarcity of samarium and cobalt, a new series of less expensive neodymium-iron-boron permanent magnets have been developed (neodymium is cheaper than samarium and iron is cheaper than cobalt). Among these the neodymium-iron-boron permanent magnets produced by the powder metallurgical method developed by Sagawa of Sumitomo Co., Japan in 1983 and those produced by a fast solidifying method developed by Croat of General Motors Co., U.S.A. are considered representative. However, the neodymium-iron-boron magnet powders are even more active in air than samarium-cobalt magnet powders and therefore the prevention of oxidation becomes much more critical. In the production of sintered magnets, the prevention of oxidation is even more difficult. One approach has been fabricating the magnets in a vacuum or an inert atmosphere. This method is effective in preventing some oxidation of magnet powders, however, complete prevention of oxidation in air is rather difficult and costly.

Phosphate or phosphoric acid in aqueous solution in combination with a minute amount of nylon and silicone oil have been used and taught as effective in preventing oxidation of magnet powders of average particle sizes from tens to hundreds of micrometers in the production of plastic magnets. The process is effective on plastic materials injection molded at about 200°-230° C. Typical references are U.S. Pat. No. 4,497,722 issued to Tsuchida et al. on Feb. 5, 1985 and Japan Laid-open Patent Application No. (Sho)60-188459 filed by Nakatsuka et al. and laid-open on Sept. 25, 1985. No reference to the prevention of the oxidation of powder metallurgical neodymium-iron-boron magnet powders has been disclosed.

Lubricants for the production of rare earth magnets such as Elvaoite, Microwax, Acrawax, Carbowax, stearic acid and stearate have been disclosed as being effective in preventing oxidation to a limited extent. Typical references are Japanese Laid-open Patent Application No. (Sho)61-90401 laid-open on Mar. 8, 1985 and U.S. Pat. No. 3,964,939 issued to Chandross et al. on Jun. 22, 1976. This approach is inapplicable to the prevention of the oxidation of powder metallurgical neodymium-iron-boron magnet powders due to its limited ability to prevent oxidation.

Some special dyes such as direct dyes, acidic dyes, alkaline dyes, hardening dyes, medium dyes, oily dyes and dispersing dyes which possess anti-oxidant characteristics are frequently used in the production of rare earth plastic magnets which are made or used at elevated temperatures. One typical reference is U.S. Pat. No. 3,892,600 issued to Smeggil et al. on Jul. 1, 1975. No reference to the prevention of the oxidation of powder metallurgical neodymium-iron-boron magnet powders has been disclosed.

Japanese Laid-open Patent Application No. (Sho) 60-244004 discloses the use of organopolysiloxane as the coupling agent in the production of plastic magnets to improve the mixing and bonding of the magnetic powder and the plastic components. Japanese Laid-open Patent Application No. (Sho)60-14406 discloses the use of titanate coupling agents in similar processes. No implication to prevention of oxidation in the production of sintered magnets has been disclosed.

Although there have been some instances in which the oxidation of magnetic powder in the production of plastic magnets has been successfully prevented by some anti-oxidants, there has not been a satisfactory method of preventing oxidation using anti-oxidants for the production of rare-earth magnets employing a powder metallurgical process.

It is therefore desirable to provide a method of effectively and economically preventing the oxidation of magnetic powders in the powder metallurgical production of rare-earth neodymium-iron-boron magnets, which method, or course, is also applicable to the production of rare earth-cobalt magnets.

SUMMARY OF THE INVENTION

It is an object of the present invention to provide a method of preventing oxidation of magnetic powders in the production of sintered magnets.

It is another object of the present invention to provide a method of preparing sintered rare-earth magnets of improved magnetic properties.

It is yet another object of the present invention to provide a method of preventing oxidation of neodymium-iron-boron magnetic powders in the production of neodymium-iron-boron magnets.

It is a further object of the invention to increase the rate of recovery of magnetic powder after ball milling.

The subject invention provides a process for producing a rare earth magnet of magnetically improved performance comprising the steps of:

(1) alloying the ingredient elements of said rare earth magnet to give an ingot;

(2) crushing said ingot to give coarse particles of an average particle size between 80 and 120 microns;

(3) milling said coarse particles with the titanate coupling agent of the formula $$(R^1O)_m—Ti(O—X—R^2)_n$$

wherein m is from 1 to 5;

n is 2 or 3;

$R^1$ is hydrogen or $C_1$–$C_{10}$ alkyl;

X is phosphate, pyrophosphate or phosphite; and $R^2$ is $C_3$–$C_{15}$ alkyl;

to give a premix;

(4) drying said premix in vacuum or an inert atmosphere;

(5) pressing and magnetizing said dried premix in a magnetic aligning field to give a magnetized article of desired shape, and (6) sintering said magnetized article by elevating the temperature to a sintering temperature and then sintering the article at the sintering temperature, which includes a slow heating degassing phase to remove any residual titanate, in which the temperature is raised from 400° to 500° C. at a temperature increasing rate between 0.5° and 5° C. per minute before said sintering temperature is reached.

DETAILED DESCRIPTION OF THE INVENTION

Figure 1:
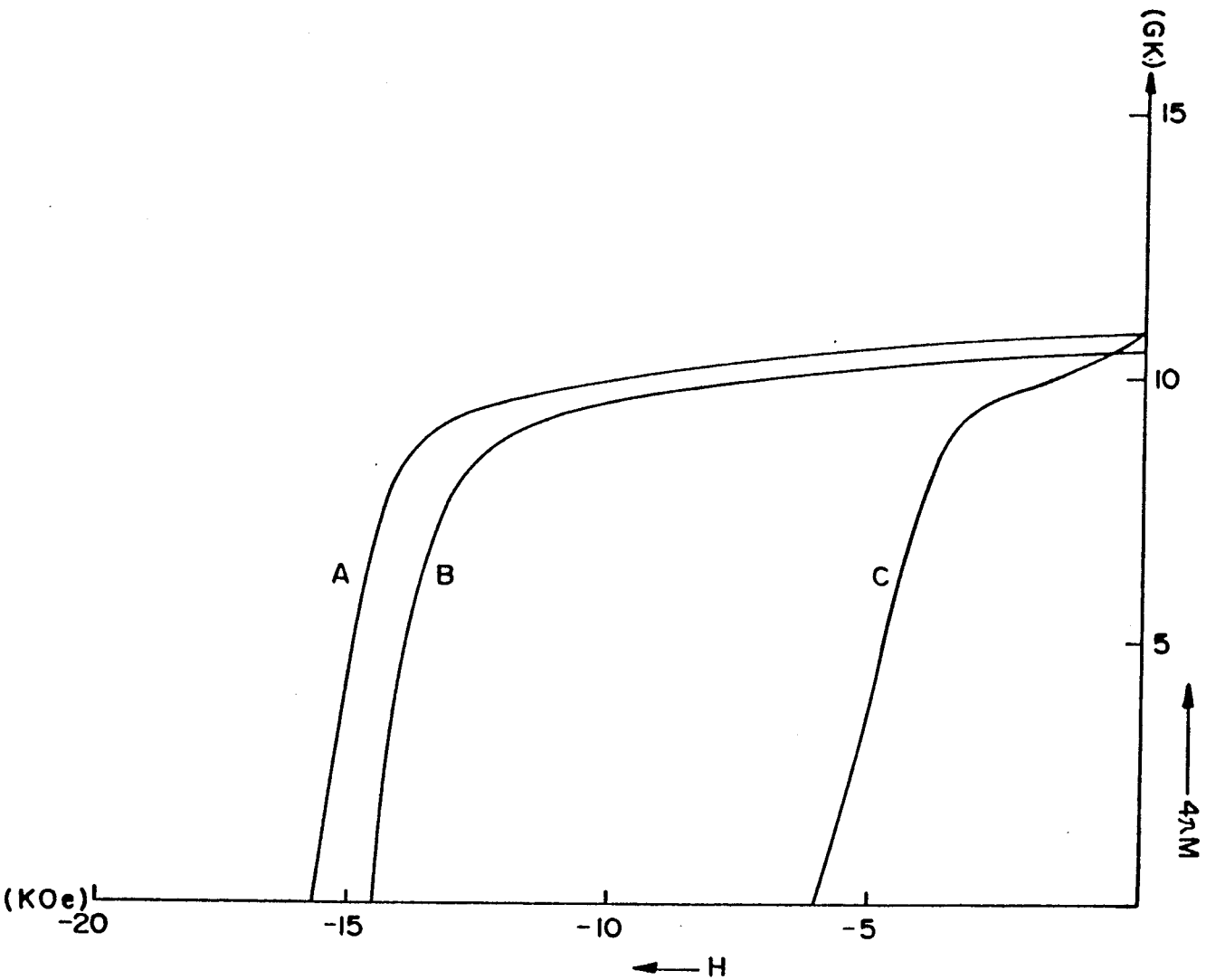
FIGS. 1 and 2 are the results of the appended examples illustrating the improvement in magnetic properties of the magnets prepared according to the present invention over prior art magnets.

While this specification concludes with claims particularly pointing out and distinctly claiming that which is considered to be the invention, it is believed that the invention can be better understood from a reading of the following detailed description of the invention and the appended examples.

The process of the present invention starts by alloying the ingredient elements of the desired rare earth magnet to give an ingot. The term "ingredient elements" refers to elements conventionally known for producing rare earth magnets. The present invention is particularly suitable for two categories of rare earth magnets. One of which as typified by neodymium-iron-boron permanent magnets may be represented by $R'_xT'_{100-x-y}B_y$ in which R' is neodymium, praseodymium, dysprosium, terbium or any mixture thereof, preferably neodymium or praseodymium; T' is iron, cobalt or any mixture thereof; B is boron; x is from 13 to 20; and y is from 5 to 12. The other category as typified by samarium-cobalt magnets may be represented by the formula $R''T''_z$ in which R'' is samarium, praseodymium or any mixture thereof, preferably samarium; T'' is cobalt, iron, copper, zinc or any mixture thereof; and z is from 4.0 to 9.5. The alloying of these elements is preferably carried out on an induction furnace by any conventional process.

The resultant alloy ingots are then crushed to give coarse particles with average particle size between 80 and 120 microns. The resultant coarse particles are then milled by, for example, a ball mill. A titanate coupling agent is added during the milling to impart anti-oxidation ability to the particles in the following processing. This addition also has the effect of increasing the recovery rate of the powder during ball milling. The titanate coupling agent contemplated by the present invention may be represented by the formula $(R^1O)_m$—Ti(O—X—$R^2)_n$ in which m is from 1 to 5; n is 2 or 3; $R^1$ is hydrogen or $C_1$–$C_{10}$ alkyl; X is phosphate, pyrophosphate or phosphite; and $R^2$ is $C_3$–$C_{15}$ alkyl. The milling step is preferably carried out in an organic solvent which may be methanol, ethanol, isopropanol, toluene, xylene, n-hexane or cyclohexane. The milling continues until the average particle size of the particles reaches below about 3μ. The resultant mixture is then dried in vacuum or an inert atmosphere. After drying, the alloy particles are oxidation-resistant and may be further processed in an unprotected atmosphere. These further processing steps include powder metallurgy, magnetization and sintering. Since the anti-oxidation ability is effectively improved by the addition of the specific anti-oxidant, the magnetization and magnetic reproducibility of the present invention may be improved. This is one of the novel aspects of the present invention.

The protected alloy particles are then pressed in a mould by conventional powder metallurgical process under a magnetic aligning field to give a magnet of desired shape. The magnet is then heated to a sintering temperature and then sintered under the sintering temperature to produce the final product. The sintering temperature is typically from 1040° to 1120° C. During the sintering step, however, a special slow-heating, degassing stage must be involved before the temperature is raised to the sintering temperature to remove the residual anti-oxidant. The temperature is preferably raised from about 400° to about 500° C. at a rate of between 0.5° and 5° C./min.

The sintered magnet may be further heat-treated by conventional methods to impart other desired properties.

The following examples are offered to aid in the understanding of the present invention and are not to be construed as limited the scope thereof. Unless otherwise indicated, all parts and percentages are by weight.

The magnetic properties in the examples are determined by DC Magnetic Hysteresis Loop Tracer (Type 3257) of YEW Co.

EXAMPLE 1

100 grams of $(Nd_{0.9}Dy_{0.1})_{15}Fe_{77}B_8$ ingots were crushed to ASTM 40 mesh and then ball-milled in hexane to obtain an average particle size of F.S.S.S. 3.0±0.2 μm. 0.33 grams of neoalkoxyl tri(dioctyl)phosphate titanate were added as the anti-oxidant during the milling. The resultant mixture was then dried by heating under vacuum. The dry powder was then press-molded in atmosphere into cubes of 1 cm side length in a 15 kOe external magnetic field. The direction of the magnetic field was perpendicular to the direction of the pressing. The resultant green compact was then subjected to sintering in a vacuum at 1080° C. for 1 hour followed by quenching. The temperature was raised from room temperature to 1080° C. at a rate of about 15° C./min, but the temperature was slowly raised from 400° to 500° C. at the rate of about 3.5° C./min. This slow rise constitutes the degassing stage. The green compact was then subjected to heat-treatment at 600° C. for about 1 hour. The magnetic properties of the resultant magnet were recorded as shown by Curve A of FIG. 1.

As a comparative experiment the above procedure was carried out but the neoalkoxyl tri(dioctyl) phosphate titanate was not added. The resultant magnet was also measured and recorded as shown in Curve B of FIG. 1.

As a second comparative experiment, the above procedure was carried out with the addition of anti-oxidant but without the degassing step. The resultant magnet was also measured and recorded as shown by curve C of FIG. 1. It is evident that the degassing step is important to this invention.

It is clear from FIG. 1 that the properties of the magnet produced according to the present invention are superior.

EXAMPLE 2

Magnets were prepared following the same procedures described above but $(Nd_{0.88}Dy_{0.12})_{15}Fe_{77}B_8$ ingots were used and neoalkoxyl tri(dioxtyl) pyrophosphate titantate was used as the anti-oxidant. The amount of the anti-oxidant was varied in different preparations. The maximum energy product ($(BH)_{max}$), remanence (Br), intrinsic coercivity (iHc) and density (D) of these products were determined and listed in Table I.

TABLE I

| Amount of Anti-oxidant (wt %) | $(BH)_{max}$ ($MGO_e$) | Br (kG) | iHc ($kO_e$) | D ($g/cm^3$) |
|---|---|---|---|---|
| 0 | 24.5 | 10.3 | 13.7 | 7.46 |
| 0.005 | 26.0 | 10.8 | 14.7 | 7.48 |
| 0.10 | 28.0 | 10.9 | 14.7 | 7.51 |
| 0.33 | 28.8 | 11.3 | 15.9 | 7.50 |
| 0.52 | 29.6 | 11.4 | 17.0 | 7.47 |
| 0.85 | 30.3 | 11.2 | 17.3 | 7.48 |
| 1.21 | 29.3 | 10.9 | 17.4 | 7.45 |
| 1.57 | 28.7 | 10.8 | 17.3 | 7.45 |
| 1.94 | 27.0 | 10.5 | 16.8 | 7.44 |
| 2.47 | 24.0 | 10.0 | 15.0 | 7.42 |
| 2.98 | 20.9 | 9.4 | 12.8 | 7.40 |
| 4.05 | 13.5 | 7.8 | 9.0 | 7.38 |
| 5.07 | 3.5 | 4.3 | 2.5 | 7.35 |

EXAMPLE 3

100 grams of $(Nd_{0.8}Tb_{0.2})_{13}Fe_{81}B_6$ ingots were crushed to ASTM 40 mesh and then ball-milled in ethanol to obtain an average particle size of F.S.S.S. 2.5±1.0 μm. 0.85 grams of di(dioctyl) pyrophosphate oxoethylene titanate were added as anti-oxidant during the milling. The resultant mixture was then dried by heating under vacuum. The dry powder was divided into five groups and then exposed under atmosphere for 0, 1, 2, 3 and 4 hours respectively and then press-molded into cubes of 1 cm side length in a 15 kOe external magnetic field. The direction of the magnetic field was parallel to the direction of the pressing. The resultant green compact was then subjected to the same sintering and heat-treatment procedure as described in Example 1 and the magnetic properties of the resultant magnet were determined with the same procedures and listed as shown by Table II.

As a comparative experiment the above procedure was carried out but the anti-oxidant was not added. The properties of the resultant magnets were also determined and listed as shown by Table III.

TABLE II

| Exposure time (hr) | $(BH)_{max}$ ($MGO_e$) | Br (kG) | iHc ($kO_e$) |
|---|---|---|---|
| 0 | 26.6 | 10.7 | 12.0 |
| 1 | 26.0 | 10.7 | 11.9 |
| 2 | 26.5 | 10.7 | 11.8 |
| 3 | 26.5 | 10.7 | 11.9 |
| 4 | 26.0 | 10.7 | 11.9 |

TABLE III

| Exposure time (hr) | $(BH)_{max}$ ($MGO_e$) | Br (kG) | iHc ($kO_e$) |
|---|---|---|---|
| 0 | 23.5 | 10.2 | 12.0 |
| 1 | 23.0 | 10.1 | 12.0 |
| 2 | 22.5 | 10.0 | 11.7 |
| 3 | 21.0 | 9.7 | 11.2 |
| 4 | 18.0 | 9.0 | 11.1 |

As shown in Table II, the powder prepared according to the present invention essentially does not degrade after exposure to air for as long as four hours. On the contrary, if the anti-oxidant is not added, the magnetization of the resultant magnets decreases as the exposure time increases.

EXAMPLE 4

$Nd_{20}Fe_{68}B_{12}$ ingots were ball-milled in toluene for 40 minutes. In 7 experiments 0, 0.005, 0.21, 0.44, 0.85, 2.2 and 5.0 wt % of di(dioctyl) pyrophosphate oxoethylene titanate respectively were added as the anti-oxidant during the milling. The resultant mixtures were then dried, press-molded, sintered and heat-treated as described in Example 1. The resultant magnets were then polished and analyzed by LECO TC-136 nitrogen-oxygen analyzer to determine their oxygen contents, giving the results as shown in Table 4. The average particle sizes of the dry powders were also measured before press-molding.

It is herein demonstrated that oxygen content significantly decrease in response to the increase in the amount of anti-oxidant added. The addition of anti-oxidant also helps to lower the average particle size of the magnetic dry powders. Similarly such addition during ball milling produces the desired powder size in a shorter time because the crushing rate is increased.

TABLE IV

| Added amount of Anti-oxidant (wt %) | Particle Size F.S.S. (μm) | Oxygen Content (ppm) |
|---|---|---|
| 0 | 2.65 | 6550 |
| 0.005 | 2.62 | 7800 |
| 0.21 | 2.58 | 6250 |
| 0.44 | 2.54 | 5285 |
| 0.85 | 2.50 | 5220 |
| 2.2 | 2.52 | 5310 |
| 5.0 | 2.64 | 5155 |

EXAMPLE 5

Figure 2:
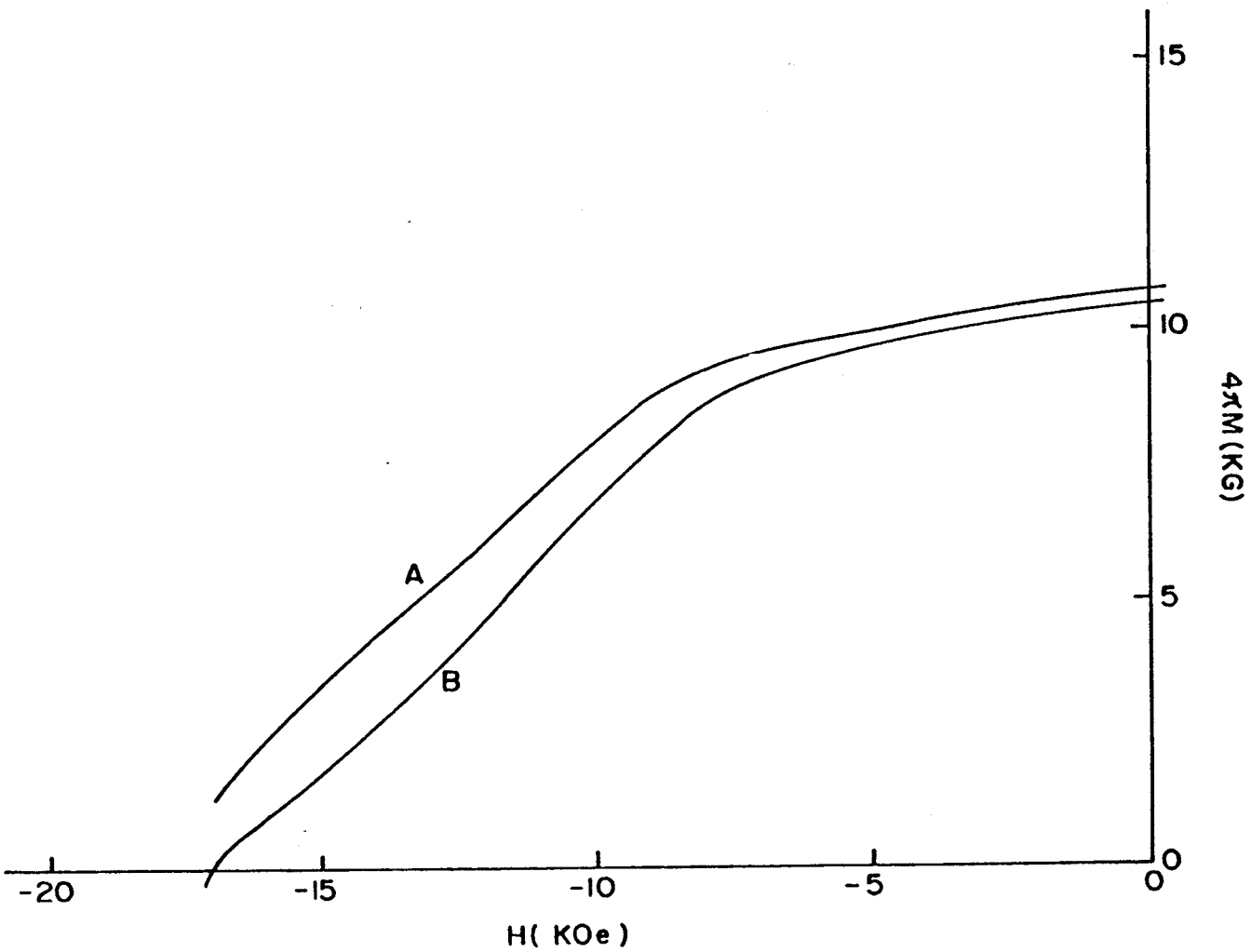

$Sm(CO_{0.65}Fe_{0.27}Cu_{0.06}Zr_{0.02})_{7.5}$ ingots were ball-milled in cyclohexane to obtain an average particle size of F.S.S.S. 4.5±0.2 μm. 0.2 wt % of di(dioctyl) phosphate ethylene titanate were added as anti-oxidant during milling. The resultant mixture was then dried by heating under vacuum. The dry powder was then press-molded into cubes of 1 cm side length in a 15 kOe external magnetic field. The direction of the magnetic field was perpendicular to the direction of the pressing. The resultant green compact was then sintered at 1150° C. for 1 hour with the same slow-heating stage of Example 1 and then heat-treated with the following temperature sequence: 850° C.×10 hr.+700° C.×1 hr+600° C.×1 hr+400° C.×1 hr. The magnetic properties of the resultant magnet were measured and recorded as shown by Curve A FIG. 2.

As a comparative experiment the above procedure is carried out but the di(dioctyl) phosphate ethylene titanate was not added. The properties of the resultant magnet was also determined and recorded as shown by Curve B of FIG. 2. The addition of anti-oxidant of the present invention was proved to be able to increase the (BH)max value by 9%.

EXAMPLE 6

100 grams of $Nd_{15}Fe_{77}B_8$ ingots were crushed to ASTM 40 mesh and then ball-milled in n-hexane. The ball:magnetic powder ratio is 10:1. 0.33 grams of titanium coupling agent were added during the milling. After 30 minutes of milling, the magnetic powder and the balls were separated and the magnetic powder dried. The resultant magnetic powder weighed 96% of its weight before ball-milling. That is, the rate of recovery is 96%. The rate of recovery without the addition of anti-oxidant is 85%. This increases the yield by almost 13% over the same process without the anti-oxidant. This is attributable to the reduction of the amount of magnetic powder adhered to the steel ball used for ball-milling due to the presence of the anti-oxidant. As a result the cost of production is lower.

We claim:

1. Process for producing a rare earth magnet of magnetically improved performance comprising the steps of:
   (1) alloying the ingredient elements of said rare earth magnet to give an ingot;
   (2) crushing said ingot to give coarse particles of an average particle size between 80 and 120 microns;
   (3) milling said coarse particles with the titanate coupling agent of the formula $$(R^1O)_m—Ti(O—X—R^2)_n$$

wherein
   m is from 1 to 5;
   n is 2 or 3;
   $R^1$ is hydrogen or $C_1$–$C_{10}$ alkyl;
   X is phosphate, pyrophosphate or phosphite; and
   $R^2$ is $C_3$–$C_{15}$ alkyl;
   to give a premix;
   (4) drying said premix in vacuum or an inert atmosphere;
   (5) pressing and magnetizing said dried premix in a magnetic aligning field to give a magnetized article of desired shape, and
   (6) sintering said magnetized article by elevating the temperature to a sintering temperature, and then sintering said article at said sintering temperature, which includes a slow heating degassing phase to remove any residual titanate, in which the temperature is raised from 400° to 500° C. at a temperature increasing rate between 0.5° and 5° C. per minute before said sintering temperature is reached.

2. The process as claimed in claim 1, wherein said milling step is carried out in an organic solvent selected from the group consisting of methanol, ethanol, isopropanol, toluene, xylene, n-hexane and cyclohexane.

3. The process as claimed in claim 1, wherein said rare earth magnet is a rare earth magnet of the formula $R'_xT'_{100-x-y}B_y$ in which
   R' is neodymium, praseodymium, dysprosium, terbium or any mixture thereof;
   T' is iron, cobalt or any mixture thereof;
   B is boron;
   X is formed 13 to 20; and
   Y is from 5 to 12.

4. The process as claimed in claim 3, wherein said R' is neodymium or praseodymium.

5. The process as claimed in claim 1, wherein said rare earth magnet is a rare earth magnet of the formula $R''T''_z$ wherein
   R'' is samarium, praseodymium or any mixture thereof;
   T'' is cobalt, iron, copper, zinc or any mixture thereof; and
   z is from 4.0 to 9.5.

6. The process as claimed in claim 5 wherein said R'' is samarium.

7. The process as claimed in claim 1, wherein said titanate coupling agent is selected from the group consisting of neoalkoxyl tri(dioctyl) pyrophosphate titanate, neoalkoxyl tri(dioctyl) pyrophosphate titanate, di(dioctyl) pyrosphosphate oxoethylene titanate and di(dioctyl) phosphate ethylene titanate.

8. The process as claimed in claim 1, wherein the amount of said titanate coupling agent is between 0.005 and 5% by weight based on the total amount of said premix.

9. The process as claimed in claim 8, wherein the amount of said titanate coupling agent is between 0.005 and 2.5% by weight based on the total amount of said premix.

10. The process as claimed in claim 1, wherein said vacuum is below 0.1 torr.

11. The process as claimed in claim 1, wherein said inert atmosphere is nitrogen or argon atmosphere.

12. The process as claimed in claim 1, wherein said sintering temperature is from 1040° to 1120° C.

13. A process for improving the rate of recovery of a rare earth magnetic powder comprising:
   (a) alloying the ingredient elements of said rare earth magnet to produce an ingot;
   (b) crushing said ingot to give coarse particles of an average particle size between 80 and 120 microns
   (c) adding a titanate coupling agent of the formula $$(R^1O)_m—Ti(O—X—R^2)_n$$

wherein
   m is from 1 to 5;
   n is 2 or 3;
   $R^1$ is hydrogen or $C_1$–$C_{10}$ alkyl;
   y is phosphate, pyrophosphate or phosphite; and
   $R^2$ is $C_3$–$C_{15}$ alkyl; and
   (d) milling said coarse particles and said titanate together.

* * * * *